US005372737A

United States Patent [19]

Spauschus

[11] Patent Number: 5,372,737

[45] Date of Patent: Dec. 13, 1994

[54] LUBRICATING OIL COMPOSITION FOR REFRIGERANT AND METHOD OF USE

[76] Inventor: Hans O. Spauschus, 761 Woodward Way, Atlanta, Ga. 30327

[21] Appl. No.: 122,365

[22] Filed: Sep. 17, 1993

[51] Int. Cl.[5] ..... C09K 5/00

[52] U.S. Cl. ..... 252/68; 252/52 A; 252/52 R; 62/84; 62/114

[58] Field of Search ..... 252/68, 56 S, 56 R, 252/52 R, 52 A; 62/84, 114

[56] References Cited

U.S. PATENT DOCUMENTS

| | | | |
|---|---|---|---|
| 4,749,502 | 6/1988 | Alexander et al. | 252/35 |
| 5,043,085 | 8/1991 | Kinoshita et al. | 252/49.9 |
| 5,104,560 | 4/1992 | Huster et al. | 252/58 |
| 5,136,116 | 8/1992 | Ohhazama | 252/52 R |
| 5,229,025 | 7/1993 | Carter et al. | 252/68 |
| 5,254,280 | 10/1993 | Thomas et al. | 252/68 |

FOREIGN PATENT DOCUMENTS

| | | |
|---|---|---|
| 74598 | 7/1978 | Japan . |
| 103594 | 6/1983 | Japan . |
| 167907 | 9/1989 | Japan . |
| 86389 | 4/1993 | Japan . |
| 125374 | 5/1993 | Japan . |
| 2224287 | 2/1990 | United Kingdom . |

*Primary Examiner*—Prince Willis, Jr.
*Assistant Examiner*—James M. Silbermann
*Attorney, Agent, or Firm*—Jones & Askew

[57] ABSTRACT

The present invention provides for a refrigeration lubricant for use with R-134a refrigerant. The lubrication composition of the invention combines a polyalkylene glycol synthetic lubricant or a polyolester synthetic lubricant with conventional mineral oil. The composition has enhanced lubricity which is unexpected in view of the fact that mineral oil is known to be incompatible with R-134a refrigerant. The lubricant compositions of the present invention are useful to replace the R-12 refrigerant lubricants which are presently in use.

26 Claims, 2 Drawing Sheets

FIG. 1
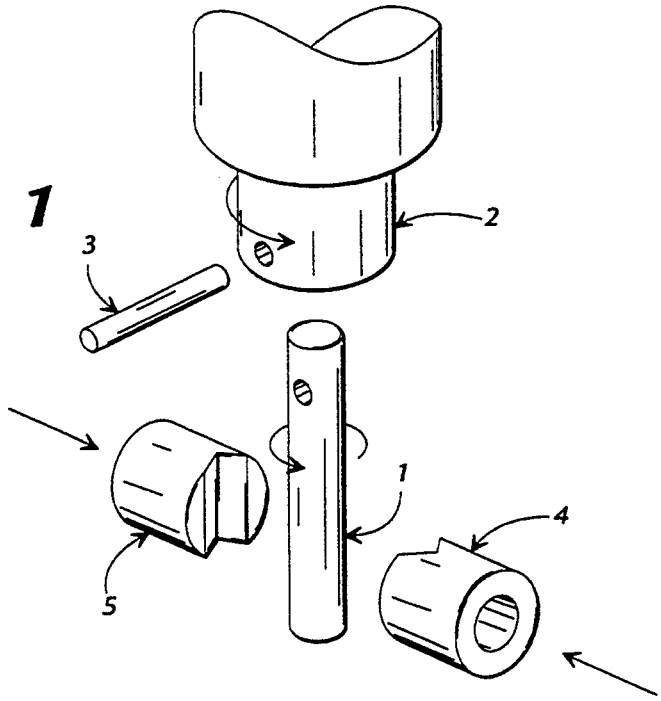
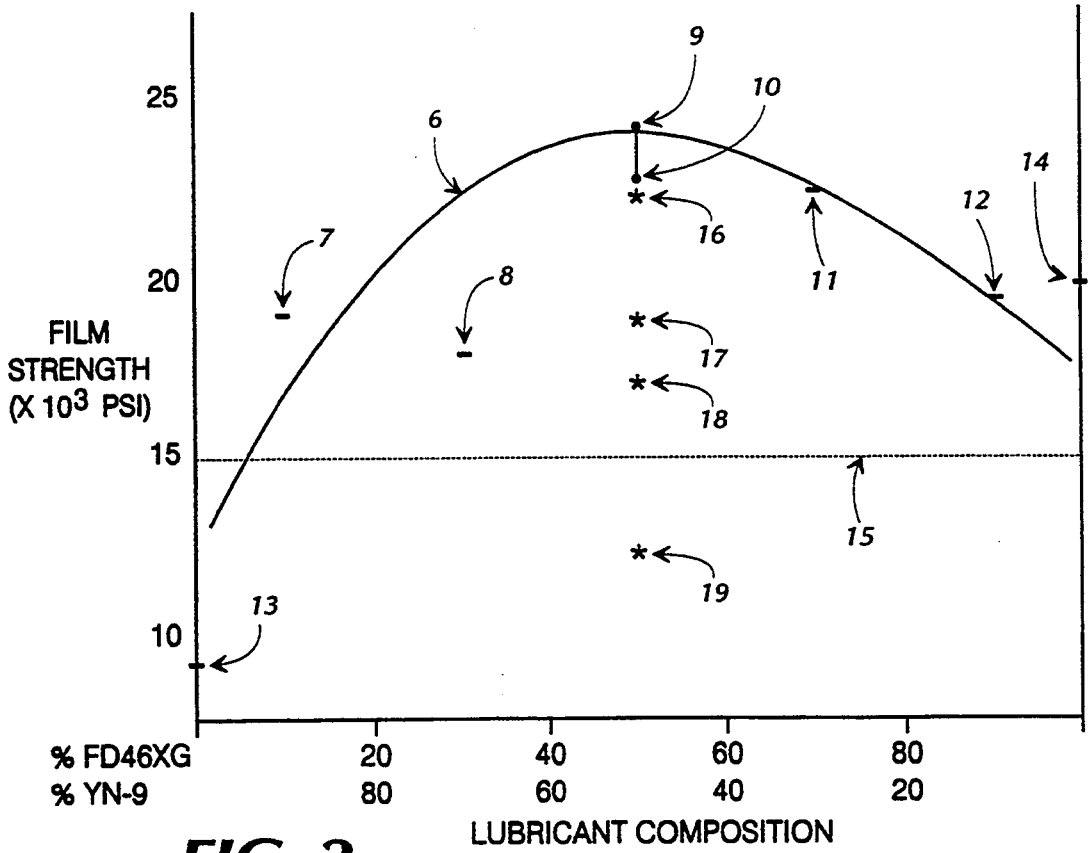
FIG. 2

LUBRICATING OIL COMPOSITION FOR REFRIGERANT AND METHOD OF USE

FIELD OF THE INVENTION

The field of the invention relates to a lubricating oil composition which is blended with a refrigerant, particularly R-134a or other HFC refrigerants for use in a conventional compression-type refrigerator or air conditioning unit. The composition is particularly useful for use in an automotive air conditioning unit.

BACKGROUND OF THE INVENTION

In conventional compression-type refrigeration ariel-/or air conditioning devices (including heat pumps) a refrigerant is compressed and circulated through the device while being subjected to alternating cycles of compression and expansion. In order to provide proper internal lubrication, particularly within the compressor, a lubricant is conventionally formulated with the refrigerant so that it can be circulated through the device along with the refrigerant.

A refrigerant which is frequently used, especially for automotive applications, is CFC-12, which is also known as R-12. The R-12 refrigerant is identified chemically as dichlorodifluoromethane. The lubricants used with the R-12 refrigerant are conventional grade mineral oils which fall within the categories of paraffinic, naphthenic and alkyl benzene oils. These mineral oils are useful with the R-12 refrigerant because they have similar solubility characteristics so that they are miscible with the R-12 refrigerant. In order for such formulations to be effective, it is essential for the lubricant to be compatible with the refrigerant. The use of lubricants which are not compatible with the refrigerant results in unacceptable compressor life in compression-type refrigerators and air conditioners. This problem is particularly troublesome in automotive air conditioners because the compressors are often not separately lubricated and, consequently, a mixture of refrigerant and lubricant circulates through the entire system. It is well known that in order for a lubricant to be compatible with a refrigerant, the: lubricant must be miscible with the refrigerant.

Although the R-12 refrigerant has highly desirable physical properties which make it useful as a refrigerant, its present use is highly discouraged because of its role in the depletion of ozone in the upper atmosphere. The ozone depletion potential of R-12 and other CFC refrigerants has led to the imposition of many environmental regulations limiting the use of such refrigerants which are known to deplete the upper atmosphere of ozone. In 1987, the signatory nations to the Montreal Protocol agreed to freeze production and use of CFCs at 1986 levels and then to reduce the amounts to 50% over the ensuing ten years. In 1990, it was further agreed by the signatory nations to eventually end all use of CFCs. Consequently, research has led to the development of refrigerants to replace the CFCs, particularly CFC-12.

A suitable refrigerant for replacing R-12 or CFC-12 should have refrigeration characteristics which are comparable to the R-12 refrigerant and should have little or no deleterious effect on atmospheric ozone. One such refrigerant is known in the trade as HFC-134a or R-134a which is identified chemically as 1,1,1,2-tetrafluoroethane. One drawback in connection with the use of R-134a as a refrigerant in compression-type refrigerators and air conditioners is that the conventional mineral oil lubricants which are used with R-12 refrigerant are not miscible with the R-134a refrigerant. Thus, development of new technology to meet the Montreal Protocol and other regulations has also focussed on the development of lubricants which are miscible with the R-134a refrigerant.

The lubricants which have been developed for use with the R-134a refrigerant are synthetic lubricants which have been disclosed in the prior art. These synthetic lubricants, as well as the conventional additives for use therewith, are disclosed in the following patents, the specifications of which are incorporated herein by reference: U.S. Pat. Nos. 2,523,863 (Cook et al.); 2,807,155 (Williamitis); 4,248,726 (Uchinuma et al.); 4,267,064 (Sasaki et al.); 4,431,557 (Shimizu et al.); 4,755,316 (Magid et al.); 4,851,144 (McGraw et al.); 4,900,463 (Thomas et al.); 4,927,554 (Jolley et al.); 4,948,525 (Sasaki et al.); 4,959,169 (McGraw et al.); 4,963,282 (Jolley et al.); 4,971,712 (Gorski et al.); 4,975,212 (Thomas et al.); 5,008,028 (Jolley et al.); 5,017,300 (Raynolds); 5,021,179 (Zehler et al.); 5,021,180 (McGraw); 5,027,606 (Short); 5,032,305 (Kamakura et al.); 5,032,306 (Cripps); 5,037,570 (Gorski et al.); 5,053,155 (Mahler); and 5,137,650 (Kaneko).

The synthetic lubricants for use with R-134a refrigerant generally fall within the categories of polyalkylene glycols (PAG), polyol esters and polycarbonates. In particular, the lubricants listed below in Table 1, along with the generic chemical description and manufacturers are known for use with R-134a refrigerant.

TABLE I

| | |
|---|---|
| AUTOMOTIVE AIR CONDITIONING LUBRICANTS: MINERAL OILS | |
| IDEMITSU DAPHNE | Mineral oil from Apollo America; |
| HERMETIC YN-9 | Ford approved CFC-12 lubricant |
| BVM-100N | Mineral oil from BV Associates; General Motors approved CFC-12 lubricant |
| SUNISO 5GS | Naphthenic mineral oil from Witco |
| AUTOMOTIVE AIR CONDITIONING LUBRICANTS: SYNTHETICS | |
| DF46XG | PAG from Apollo America |
| RO-W-6602 | PAG from Union Carbide |
| 2320F | Polycarbonate from Mitsui |
| RL-1681 | Polyolester from Mobil |
| ICEMATIC SW 100 | Polyolester from Castrol |
| OS96290 | Polyolester from Lubrizol |
| SONTEX SEZ-80 | Polyolester from Pennzoil/DEA |
| ANDEROL R-2845 | Refrigeration lubricant from Huls America, Inc. |
| EMKARATE RL-375 | Polyolester from ICI |
| 3202-20 | Polyolester firom Henkel/Emery |
| 70E-100-40 | Polyolester from Unocal |

The incompatibility between the aforementioned mineral oil lubricants also causes problems when introducing R-134a refrigerant/lubricant formulation into air conditioners or refrigerators, particularly automotive air conditioners, which already contain R-12 refrigerant/mineral oil formulations. This is because residual amounts of mineral oil and refrigerant typically remain in the system when changing an existing system from R-12 to R-134a. Thus, the incompatibility between the residual R-12 mineral oil formulation and the newly-introduced R-134a/lubricant will be troublesome. Consequently, it would be highly desirable to be able to eliminate such incompatibility when retrofitting an existing R-12 system with R-134a. The synthetic lubricants which are used with R-134a refrigerant are significantly more expensive than the mineral oil used for the R-12. Thus, substituting R-134a for R-12 involves a considerable added expense due to the price differential between the synthetic lubricants and the mineral oil lubricants. Thus, it would be highly desirable if a lubricant could be formulated which is compatible with R-134a and which utilizes a significant amount of the cheaper mineral oil.

SUMMARY OF THE INVENTION

It is an objective of this invention to provide a lubricant which is compatible with R-134a and which can be used to retrofit existing air conditioning systems containing R-12/mineral oil lubricant without the above-described incompatibility problems.

It is also an objective of this invention to provide a lubricant for use with R-134a which has enhanced lubricating properties compared to existing formulations.

It is also an objective of this invention to provide a blend of lubricants which, when used with R-134a, provides an unexpected superior lubricity than that which is achievable through the use of the individual lubricants contained in the blend.

It is also an objective of this invention to use inexpensive mineral oil with R-134a refrigerant in a compression-type air conditioner or refrigerator without incurring the problems associated with incompatibility between mineral oil and R-134a.

These and other objectives are met by blending the mineral oil with certain synthetic lubricants. It has been discovered that certain types of synthetic lubricants which are known to be compatible and useful with R-134a can be blended with conventional mineral oil lubricants and the blend is compatible with the R-134a, notwithstanding the fact that it contains a large amount of mineral oil.

Furthermore, it has been discovered that some of the synthetic lubricant/mineral oil blends are not only compatible with R-134a; but the lubricity properties of the blend is better than that which is achievable when either the synthetic lubricant or mineral oil is used as the sole lubricant with R-134a. In other words, it has been discovered that certain synthetic lubricants act synergistically with mineral oil when used with R-134a refrigerant in a compression-type air conditioner or refrigerator.

It is surprising that mineral oil can be used in a lubricant formulation which is compatible with R-134a refrigerant and still more surprising that the synthetic lubricant and mineral oil can act synergistically with each other to produce enhanced lubrication.

The prior art has taught consistently that mineral oil should be avoided as a lubricant when R-134a is chosen as the refrigerant and for this reason, other synthetic lubricants have been formulated for use with R-134a. For example, U.S. Pat. No. 4,927,554 (Jolley et al.) teaches that mineral oil is incompatible with HFC-134a (R-134a).

In U.S. Pat. No. 4,755,316 (Magid et al.), it is stated that R-134a is not miscible with mineral oils and that consequently, different lubricants are required for use with R-134a. Magid et al. further state that the immiscibility results in separation of the lubricant from the refrigerant and such separation would be expected to result in severe operational problems.

U.S. Pat. No. 4,900,463 (Thomas et al.) teaches that a blend of two lubricants can be used so as to benefit from the properties of each individual component. However, Thomas et al. further state that one requirement for such a blend is that the two lubricants form a single phase because if two phases resulted, distribution of the lubricants' components would be uneven in various compressor pans. Nonetheless, Thomas et al. avoid blends containing mineral oil because the R-134a is not miscible therewith and the immiscibility would result in unwanted separation.

The synthetic: lubricating oils which can be successfully blended with mineral oil to produce a formulation which is compatible with R-134a refrigerant are identified chemically as polyalkylene glycol lubricants and polyolester lubricants. It has also been observed that polycarbonate lubricants can also be successfully blended with mineral oil for use with R-134a, but this class of synthetic lubricants is less desirable for this purpose because of other considerations. The polyalkylene glycol, polyolester and polycarbonate lubricants, which are useful in this invention, are well known in the prior an and are specifically soId for refrigerant lubrication purposes.

It has also been discovered that certain polyalkylene glycol and polyolester synthetic refrigeration lubricants have highly desirable miscibility characteristics so that when they are blended with mineral oil and saturated with R-134a refrigerant, phase separation occurs after the lubricants and refrigerant have been mixed together, but the resulting liquid phases are cloudy (thereby indicating partial solubility/miscibility). It has been discovered that such cloudy blends of polyalkylene glycol/mineral oil/R-134a and polyolester/mineral oil/R-134a have enhanced lubricity compared to the lubricity achieved with any of these lubricant when used alone with R-134a.

The compositions of the present invention are not only advantageous for use with new air conditioners and refrigerators, but they are also advantageous for retrofitting existing R-12-containing systems because the compositions of the invention utilize the same mineral oil used in conventional R-12 refrigeration systems.

BRIEF DESCRIPTION OF THE DRAWINGS

FIG. 1 is an exploded view of the apparatus for conducting a Falex wear test;

FIG. 2 is a graph which shows the lubricating characteristics of the present invention.

DETAILED DESCRIPTION OF THE INVENTION AND PREFERRED EMBODIMENTS

Figure 3:
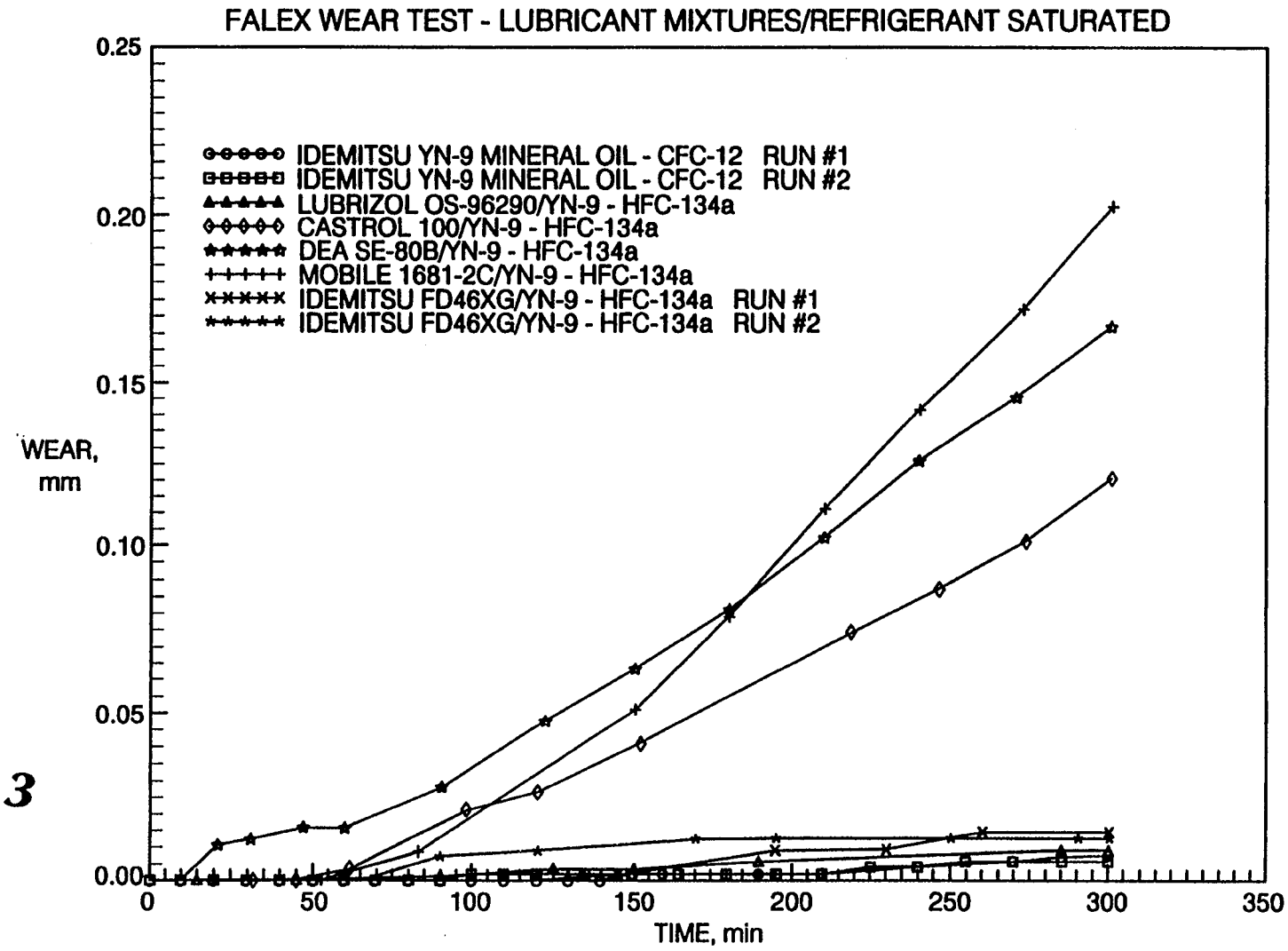
FIG. 3 is a graph which shows wear versus time for various lubricant/refrigerant compositions.

The preferred synthetic lubricant for use in this invention is polyalkylene glycol refrigeration lubricant such as monohydroxypolyalkylene glycol. An example of such a lubricant is the polyalkylene glycol lubricant made by Idemitsu Kosan Corporation and sold by Apollo America Corporation in the United States under the name "FD46XG." The FD46XG lubricant has an ISO viscosity of 46 cSt at 40° C.

Another preferred synthetic lubricant is a polyolester, such as the polyolester which is commercially available from Lubrizol under the name of "Lubrizol 96290."

Any refrigerant grade mineral oil such as those which are commercially available as refrigeration lubricants may be used in accordance with this invention. Thus, any of the above-mentioned paraffinic or naphthenic mineral oils are suitable for the present invention. One suitable mineral oil is manufactured by Idemitsu Kosan Corporation and is sold by Apollo America in the United States as "YN-9" mineral oil (also known as "Daphne Hermetic EX" mineral oil) which is identified chemically as a paraffinic mineral oil. Another mineral oil which is useful is sold commercially by BV Associates under the name "BVM-100N." The "BVM-100N" is identified chemically as a paraffinic mineral oil. Another suitable mineral oil is sold commercially by WITCO Company under the name "Suniso 5GS." The "Suniso 5GS" is identified chemically as a naphthenic mineral oil. Any of the conventional lubricant additives such as phosphate and the additives mentioned in the above-referenced patents may be employed in the present invention.

The ability of the lubricant to provide adequate lubrication for compressive-type air conditioners and refrigerators is conventionally measured by a five-hour Falex wear test. The Falex wear test is a constant load wear test which is known to correlate well with compressor lubrication performance. The Falex wear test is described in the following publications which are incorporated herein by reference:

(1) Spauschus, Henderson and Huttenlocher, Boundary Lubrication Properties of Alternative Working Fluids, Proceedings of the International Seminar on New Technology of Alternative Refrigerants, Japanese Association of Refrigeration, Tokyo, Feb. 8–10, 1993, p. 33–38.

(2) Davis and Vinci, Formulation of Polyol Ester Lubricants for Use with HFC Refrigerants, Proceedings of the International Seminar on New Technology of Alternative Refrigerants, Japanese Association of Refrigeration, Tokyo, Feb. 8–10, 1993, p. 15–20.

The Falex wear test uses test specimens in the form of pins and V-blocks. The test mechanics are such that metal-to-metal contact of the test specimens occurs throughout most of the testing procedure. The testing apparatus and procedure can be understood by reference to FIG. 1. As shown in FIG. 1, a pin 1 is locked into a journal 2 by means of a brass locking pin 3. The journal revolves at 290 rpm while a pair of V-blocks indicated by reference numerals 4 and 5, are pressed into engagement against the rotating pin 1. The test is conducted for five hours at 250 pounds load in refrigerant saturated test oil at 1 atmosphere pressure. Unless stated otherwise herein, the test specimens utilized are steel pins (Falex 8 SAE 3135, Rc=20) and 390 Die-cast aluminum V-blocks (St content=16.5% and Cu content=5.6%). The following characteristics axe observed and measured during the test:

(1) Wear, in min. This value is derived from ratchet wheel "tooth" displacement and is a measure of the wear-block surface displacement or indentation during the test;

(2) Sear, in min. This is the wear scar width on the test blocks. Scar width times the scar length (a constant value) gives the wear contact area;

(3) Load, in psi, at test completion is derived from the test load and wear contact area in (2) above. It is a measure of a lubricant's effectiveness relating to its film strength and its capability to prevent metal-to-metal contact under conditions of boundary lubrications;

(4) Final temperature (oil sump). This is a rough measure of the general wear conditions of a test run. Wear and accompanying high friction produce heat.

In order to establish a base line for adequate lubricity, the Faiex wear test was conducted with mineral oil saturated with R-12 refrigerant because this combination is known to have adequate lubricity characteristics in compressive-type air conditioners. As a comparison, the test was also performed with various known commercially-available synthetic lubricants which are known lubricants for use with R-134a. The synthetic lubricants were either neat (i.e., not mixed with mineral oil in accordance with the prior art) or combined with varying amounts of mineral oil in accordance with the present invention. When testing the synthetic lubricants, they were saturated with the R-134a since this is the refrigerant which is used with these synthetic lubricants. A Falex wear test was also performed with mineral oil ("YN-9") saturated with R-134a for comparison. Thus, the test indicates firstly whether the lubricant meets the requirements as established with R-12/mineral oil combination already in use and, secondly, compares the lubricity achievable with the prior art synthetic neat lubricants/R-134a and neat mineral oils/R-134a with the lubricants of the present invention, which is the blend synthetic lubricant/mineral oil/R-134a. Furthermore, by varying the amount of mineral oil combined with the synthetic lubricant, the optimum amount of synthetic lubricant and mineral oil can be ascertained.

FIG. 2 graphically illustrates the wear test results achieved when a polyalkylene glycol synthetic lubricant (which, in this case, is "FD46XG") is mixed with varying amounts of mineral oil (which, in this case, is "YN-9") and the mixture is saturated with R-134a refrigerant. Five mixtures were tested containing 10%, 30%, 50%, 70% and 90% synthetic lubricant mineral oil combinations with the results shown by data points 7 through 12 in FIG. 2. Points 9 and 10 represent values measured in two tests at the 50% level. The data points 7 through 12 are used to form the curve 6 which illustrates that the lubricity increases with increasing mineral oil content up to a content of about 50% which is quite surprising given the known incompatibility between mineral oil and R-134a refrigerant.

FIG. 2 also shows the wear test values obtained with neat mineral oil ("YN-9")/R-134a composition (reference numeral 13) and the value obtained with neat polyalkylene glycol ("FD46XG")/R-134a (reference numeral 14). For comparison, FIG. 2 shows dashed base line 15 which indicates the lubricity presently achievable with neat mineral oil/R-12. This base line serves as a reference point in determining whether the lubricant/R-134a combinations achieve adequate lubricity.

It will be noted from FIG. 2 that the lubricity of the synthetic lubricants/mineral oil combination peaks when about 50% synthetic lubricant is mixed with 50% mineral oil. Furthermore, the value at about 50% level is significantly higher than the lubricity achieved with R-134a saturated polyalkylene glycol used alone and is significantly higher than the lubricity achieved with R-134a saturated mineral oil used alone. It is very surprising that a high content of mineral oil (50%) used with R-134a would produce enhanced lubricity in view of the fact that it is known that mineral oil is immiscible with R-134a refrigerant.

A Falex wear test was also performed using the same polyalkylene glycol used in the above-described comparison ("FD46XG") with a different paraffinic mineral oil ("BVM-100N"). The amount of polyalkylene glycol was tested at the optimum 50% level. The lubricity value for this test is shown by reference numeral 16 in FIG. 2. It will be observed that substituting a different mineral oil had virtually no impact on the result in view of the close proximity between reference point 16 and reference points 9 and 10.

A Falex wear test was also performed with the lubricant formed by mixing 50% polyolester synthetic lubricant ("Lubrizol 96290") with 50% mineral oil ("YN-9") saturated with R-134a refrigerant. The test was run twice and the results are shown by reference numerals 17 and 18. Reference numeral 19 shows the results of the Falex wear test with 50% of synthetic lubricant ("ICI DGLF118") combined with 50% mineral oil saturated with R-134a.

The discovery of enhanced lubrication performance, illustrated in FIG. 2, resulted from a large number of wear tests conducted with a variety of neat and mixed lubricants, as shown in Table 2. The "Load Supported" results revealed that certain 50/50 mineral oil/synthetic lubricant mixtures performed much better than the individual lubricants. PAG synthetic lubricants in general exhibited improved performance when mixed with mineral oils. Improvements were observed for all three wear test properties; the film loads, total wear and pin weight loss. These results for neat lubricants and for 50/50 mineral oil/synthetic lubricant mixtures led to another series of wear tests wherein the composition was varied to include intermediate compositions of 10/90, 30/70, 70/30 and 90/10 volume percent mixtures, as shown in Table 3. These measurements established the curve given in FIG. 2 for mineral oil YN-9/PAG FD46XG and established the 50/50 mixture as optimum for wear performance.

It will be noted that these wear tests were conducted with aluminum V-blocks (390 cast alloy) and steel test pins (AISI 3135). These metals were chosen because they are similar to metals used in the construction of many compressor bearings. Selective tests were also conducted with steel/steel pin and V-blocks and with aluminum/aluminum pin and V-blocks. Results for steel/steel are given in Table 4 and for aluminum-/aluminum in Table 5. The data in Table 4 shows excellent wear performance for the 50/50 steel/steel combination. While there is evidence for some further improvement in film load at 90% FD46XG, the pin weight loss is minimized for the 50/50 composition.

The aluminum/aluminum wear test results in Table 5 were obtained with V-blocks of 390 die cast alloy and special forged aluminum pins. The aluminum-/aluminum combination is the most challenging metal combination for wear tests. As can be seen from the results at 100 pound direct load, the YN-9/CFC-12 combination ran the longest before failure occurred while the mixed lubricant was second and significantly better than FD46XG/R-134a without mineral oil. However at the higher load of 150 pounds, the 50/50 mixed lubricant was by far the best combination for inhibiting wear.

TABLE 2

FALEX WEAR TEST RESULTS
(Aluminum V-blocks, Steel Pins, 250 lbs, Direct Load, 5 Hour Test, R-134a Saturated)

| Oil sample | Wear Scar (MM) | Load Supported (psi) | Total Wear (mm) | Pin Wt. Loss (g) | Final Temp (C.) |
|---|---|---|---|---|---|
| Mitsui MA2320F | 0.609 | 14,900 | 0.016 | 0.004 | 96 |
| Idemitsu YN-9 (R-12) | 0.531 | 17,100 | 0.014 | 0.008 | 72 |
| RO-W-6602 | 0.453 | 20,000 | 0.011 | 0.001 | 54 |
| Suniso 5GS | 1.859 | 4,900 | 0.444 | 0.093 | 91 |
| Idemitsu YN-9 (R134a) | 0.680 | 13,300 | 0.037 | 0.007 | 82 |
| YN-9 50%/SEZ80 50% | 0.875 | 10,400 | 0.173 | 0.104 | 61 |
| YN-9 50%/MOBIIL 1681-2C 50% | 1.109 | 8,200 | 0.240 | 0.116 | 79 |
| YN-9 50%/RO-W-6602 50% | 0.422 | 21,500 | 0.011 | 0.004 | 59 |
| YN-9 50%/MITSUI 2320F 50% | 0.438 | 20,700 | 0.004 | 0.002 | 70 |
| YN-9 50% FD46XG 50%/2% Additive | 0.375 | 24,200 | 0.002 | 0.003 | 66 |
| YN-9 50%/RO-W-6602 50%/2% Additive | 0.414 | 21,900 | 0.016 | 0.000 | 51 |
| BVM100N 50%/SEZ80 50% | 0.578 | 15,700 | 0.074 | 0.038 | 55 |
| BVM100N 50%/LUBRIZOL 96290 50% | 0.547 | 16,600 | 0.018 | 0.009 | 79 |
| BVM100N 50%/RO-W-6602 50% | 0.414 | 21,900 | 0.009 | 0.001 | 65 |
| BVM100N 50%/MITSUI 2320F 50% | 0.453 | 20,000 | 0.004 | 0.001 | 85 |
| BVM100N 50%/MITSUI 2310 50% | 0.797 | 11,400 | 0.324 | 0.014 | 98 |
| Suniso 5GS 50%/SEZ80 50% | 0.953 | 9,500 | 0.210 | 0.109 | 75 |
| Suniso 5GS 50%/H.A. 2845 50% | 0.539 | 16,800 | 0.056 | 0.024 | 49 |
| Suniso 5GS 50%/RO-W-6602 50% | 0.461 | 19,700 | 0.007 | 0.003 | 53 |
| Suniso 5GS 50%/FD46XG 50% | 0.414 | 21,900 | 0.004 | 0.003 | 63 |
| Suniso 5GS 50%/FD46XG 50%/2% Additive | 0.328 | 27,600 | <0.002 | 0.001 | 66 |
| Suniso 5GS 50%/RO-W-6602 50%/2% Additive (phosphate type-antiwear additive) | 0.430 | 21,100 | 0.014 | 0.002 | 53 |

TABLE 3

WEAR TEST RESULTS FOR LUBRICANT MIXTURES WITH R-134A

| Lubricant | Test Specimens | Wear Scar (mm) | Film Load (psi) | Wear (mm) | Wt. Loss (g) | Final Temp (C.) |
|---|---|---|---|---|---|---|
| YN-9/ | Al/Steel | 0.61 | 14,900 | 0.007 | 0.007 | 96 |
| R-12 | Al/Steel | 0.63 | 14,700 | 0.005 | 0.003 | 100 |
| FD46XG/ YN-9 (10%/90%) | Al/Steel | 0.48 | 19,000 | 0.004 | 0.001 | 82 |
| FD46XG/ YN-9 (30%/70%) | Al/Steel | 0.51 | 17,900 | 0.007 | 0.008 | 86 |
| FD46XG/ YN-9 (50%/50%) | Al/ Steel Run 1 | 0.38 | 24,200 | 0.014 | 0.007 | 68 |
| | Al/ Steel Run 2 | 0.40 | 22,700 | 0.012 | 0.003 | 59 |
| FD46XG/ YN-9 (70%/30%) | Al/Steel | 0.41 | 22,300 | 0.002 | 0.006 | 78 |
| FD46XG/ YN-9 (90%/10%) | Al/Steel | 0.47 | 19,300 | 0.009 | 0.002 | 66 |
| FD46XG/ R-134a | Al/Steel | 0.002 | 21,500 | 0.002 | 0.006 | 63 |
| | | 0.004 | 18,100 | 0.004 | 0.006 | 67 |

TABLE 4

WEAR TEST RESULTS FOR LUBRICANT MIXTURES WITH R-134A

| Lubricant | Test Specimens | Wear Scar (mm) | Film Load (psi) | Wear (mm) | Wt. Loss (g) | Final Temp (C.) |
|---|---|---|---|---|---|---|
| YN-9 /R-12 | Steel/Steel | 0.61 | 14,900 | 0.115 | 0.071 | 83 |
| FD46XG/ YN-9 (10%/90%) | Steel/Steel | 0.36 | 25,200 | 0.021 | 0.024 | 74 |
| FD46XG/ YN-9 (50%/50%) | Steel/Steel | 0.27 | 34,100 | 0.012 | 0.010 | 79 |
| FD46XG/ YN-9 (90%/10%) | Steel/Steel | 0.23 | 40,000 | 0.007 | 0.014 | 75 |

TABLE 5

ALUMINUM/ALUMINUM* WEAR TESTS
Effectiveness of Mixed Lubricant

| Lubricant | Load # | Time to Failure | Wear (mm) | Final Temp (C.) |
|---|---|---|---|---|
| YN-9/R-12 | 100 | 236 min | 1.13 | 60 |
| | 150 | 32 | 1.50 | 56 |
| FD46XG/R-134A | 100 | 25 | 1.98 | 50 |
| | 150 | 5 | 0.39 | 49 |
| FD46XG + | 100 | 165 | 2.10 | 43 |
| YN-9/R-134a | 150 | 58 | 1.01 | 59 |

*Wear test specimens were 390 die cast aluminum blocks and forged aluminum pins.

TABLE 6

COMPARATIVE PROPERTIES: LUBRICANTS FOR RETROFIT AND OEM

| Lubricant/Refrigerant | Lubricity (St/Al) Neat | Lubricity (St/Al) 50/50 YN-9 | Stability Rank* 134a | Stability Rank* 134a/12 | Stability Rank* Cont. | Miscibility Rank Neat and 50/50 YN-9 |
|---|---|---|---|---|---|---|
| Idemitsu YN-9/R-12 | 14,900 14,500 | | | | | 1 |
| Idemitsu FD46XG/R-134a | 19,800 | 24,200 22,700 | 1.5 | 2 | 2 | 4 |
| Lubrizol 96290/R-134a | 13,400 | 19,000 | 2 | 4 | 3.5 | 4.5 |
| Mitsui 2310/R-134a | 9,920 | 7,950 | 1 | | 1.5 | 3 |
| Castrol 100/R-134a | 10,600 | 9,510 | 1 | 4 | 4 | 3 |
| DEA SE-80B/R-134a | 10,400 | 9,440 | 1 | 1 | 3 | 2.5 |
| Mobil 1681-2C/R-134a | 11,500 | 8,410 | 1 | 1 | 3 | 2.5 |
| Idemitsu SH-100/R-134a | 8,500 | | 2 | | 3 | 1 |
| Emery 3202/20/R-134a | 9,300 | | 1.5 | | 2 | 3.5 |

*Ranking Scale: 1.0 = Best; 5.0 = Worst

TABLE 7

BOUNDARY LUBRICATION (WEAR) TESTS

| ALUMINUM/STEEL | 250 # LOAD | R-134A SATURATED |
|---|---|---|
| EFFECT OF MINERAL OIL TYPE ON FILM LOAD | | |
| SYNTHETIC / MINERAL OIL (M.O.) | NEAT SYNTHETIC | 50/50 WITH MINERAL OIL |
| FD 46 X G / YN-9 | 19,800 | 23,500 |
| FD 46 X G / 5GS | 19,800 | 21,900 |
| FD 46 X G / BVM-100N | 19,800 | 23,000 |

TABLE 8

Boundary Lubrication (Wear) Tests

| ALUMINUM/STEEL | 250 # LOAD | SATURATED |
|---|---|---|
| EFFECT OF MINERAL OIL TYPE ON FILM LOAD | | |
| SYNTHETIC / MINERAL OIL (M.O.) | NEAT SYNTHETIC | 50/50 WITH MINERAL OIL |
| U.C. RO-W-6602 PAG / YN-9 | 20,000 | 21,500 |
| U.C. RO-W-6602 PAG / 5GS | 20,000 | 19,700 |
| U.C. RO-W-6602 PAG / BVM-100N | 20,000 | 21,900 |

TABLE 9

BOUNDARY LUBRICATION (WEAR) TESTS

| ALUMINUM/STEEL | 250 # LOAD | R-134A SATURATED |
|---|---|---|
| EFFECT OF MINERAL OIL TYPE ON FILM LOAD | | |
| SYNTHETIC / MINERAL OIL (M.O.) | NEAT SYNTHETIC | 50/50 WITH MINERAL OIL |
| PENNZOIL SONTEX SEZ-80 ESTER / YN-9 | 10,400 | 9,400 |
| PENNZOIL SONTEX SEZ-80 ESTER / 5GS | 10,400 | 9,500 |
| PENNZOIL SONTEX SEZ-80 ESTER / BVM-100N | 10,400 | 15,700 |

TABLE 10

BOUNDARY LUBRICATION (WEAR) TESTS

| ALUMINUM/STEEL | 250 # LOAD | R-134A SATURATED |
|---|---|---|
| EFFECT OF MINERAL OIL TYPE ON FILM LOAD | | |
| SYNTHETIC / MINERAL OIL (M.O.) | NEAT SYNTHETIC | 50/50 WITH MINERAL OIL |
| LUBRIZOL 96290 ESTER / YN-9 | 13,400 | 19,000 |
| LUBRIZOL / 5GS | 13,400 | 16,600 |

TABLE 11

BOUNDARY LUBRICATION (WEAR) TESTS

| ALUMINUM/STEEL | 250 # LOAD | R-134A SATURATED |
|---|---|---|
| EFFECT OF ADDITIVE (2% PHOSPHATE) | | |
| | FILM LOAD (psi) Without Additive | FILM LOAD (psi) With Additive |
| YN-9/FD45X6 (PAG) | 23,500 | 24,200 |
| YN-9/RO-W-6602 (PAG) | 21,500 | 21,900 |
| SUNISO 5GS/FD46XG | 21,900 | 27,600 |

TABLE 11-continued

| | | |
|---|---|---|
| SUNISO 5GS/RO-W-6602 | 19,700 | 21,100 |

TABLE 12

FALEX WEAR TEST RESULTS
Aluminum/Steel Specimens, 250 lbs Load, 5 Hour Test
(Lubricants Saturated with R-134a, unless noted otherwise)

| | NEAT | 50/50 YN-9 | 50/50 BVM-100N | 50/50 SUNISO 3GS |
|---|---|---|---|---|
| MINERAL OILS | | | | |
| YN-9 | 14,700 (R-12) | | | |
| YN-9 | 9,100 | | | |
| BVM-100N | 10,500 (R-12) | | | |
| SUNISO 5GS | 4,900 | | | |
| PAGs | | | | |
| FD46XG | 19,800 | 23,500* | | 21,900 |
| RO-W-6602 | 20,000 | 21,500 | 21,900 | 19,700 |
| DGLF-118 | 10,900 | | | |
| POEs | | | | |
| Lubrizol 96290 | 13,400 | 19,000 | 16,600 | |
| Castrol 100 | 10,600 | 9,500 | | |
| DEA SE-80 | 10,400 | 9,900* | 15,700 | 9,500 |
| Mobil 1681-2c | 11,500 | 8,300* | | |
| Idemitsu SH-100 | 8,500 | | | |
| Emery 3202 | 9,300 | | | |
| Anderol 2845 | 11,200 | | | |
| PCs | | | | |
| Mitsui 2310 | 9,900 | 7,950 | 11,400 | |
| Mitsui 2320 | 14,900 | 20,700 | 20,000 | |
| WITH 2% PHOSPHATE ADDITIVE | | | | |
| FD46XG | 19,800 | 24,200 | | 21,900 |
| RO-W-660 | 20,000 | 21,900 | | 21,100 |

*Average value from duplicate runs

TABLE 13

LUBRICANT FILM STRENGTH (PSI)
5 Hour Wear Test
Lubricant Saturated with R-134a
SAE 3135 Steel Test Pins and
390 Die Cast Aluminum V-Blocks

| Less than 10,000 | | Over 10,000 | |
|---|---|---|---|
| Idemitsu PAG A-3 | 7,500 | Idemitsu FD46XG (PAG) | 19,800 |
| Idemitsu SH-100 | 8,500 | Mobil 1681 2C | 11,500 |
| Mobil 1681 1C | 9,050 | Castrol Auto 100 | 10,660 |
| Mobil 1681 1D | 9,450 | ICI DGLF-118 (PAG) | 10,850 |
| Mobil 1681 2D | 9,750 | DEA Triton SE-55B | 14,600 |
| Castrol Auto 80 | 9,555 | DEA Triton SE-80B | 10,400 |
| ICI DE 375 | 7,800 | Hulls 2844 | 11,300 |
| Emery 3202-20 | 9,300 | Hulls 2845 | 11,200 |
| Unocal 70E | 9,900 | Hulls 2846 | 15,100 |
| DEA Triton SE-55 | 9,300 | Lubrizol 96290 | 13,400 |
| Planetelf | 7,100 | | |
| Baseline for Comparison: | | | |
| YN-9/R-12 | 14,700 | | |

TABLE 14

FALEX WEAR TEST DATA AT 250#
DIRECT LOAD WITH 390 ALUMINUM BLOCKS
AND SAE 3135 TEST PINS.
ALL TESTS WERE RUN FOR FIVE HOURS

| Sample | Wear (mm) | Scar (mm) | Load (psi) | Final Temp C. (F.) |
|---|---|---|---|---|
| Idemitsu YN-9 Mineral Oil | 0.007 | 0.60 | 14,9001 | 96 (206) |
| with R-12 | 0.005 | 0.63 | 4,500 | 100 (212) |
| Idemitsu FD46XG PAG/ | 0.014 | 0.38 | 24,164 | 68 (154) |
| Idemitsu YN-9 with | 0.012 | 0.40 | 22,711 | 59 (138) |
| R-134a | | | | |
| Lubrizol OS-96290 Ester/ | 0.009 | 0.48 | 19,018 | 92 (198) |

TABLE 14-continued

FALEX WEAR TEST DATA AT 250#
DIRECT LOAD WITH 390 ALUMINUM BLOCKS
AND SAE 3135 TEST PINS.
ALL TESTS WERE RUN FOR FIVE HOURS

| Sample | Wear (mm) | Scar (mm) | Load (psi) | Final Temp C. (F.) |
|---|---|---|---|---|
| Idemitsu YN-9 with R-134a | | | | |
| Castrol Auto 100/Idemitsu YN-9 with R-134a | 0.120 | 0.95 | 9,513 | 75 (167) |
| DEA SE-80B/Idemitsu YN-9 with R-134a | 0.166 | 0.96 | 9,436 | 66 (151) |
| Mobil 1681-2C/Idemitsu YN-9 with R-134a | 0.201 | 1.08 | 8,410 | 83 (181) |

Experiments were conducted to measure the miscibility/solubility performance of "YN-9"/"FD46XG" mixtures with R-134a. In these experiments, sealed tubes were prepared containing the following mixtures:

| Mixed Lubricant 50/50 YN-9/FD46XG | R-134a |
|---|---|
| a. 10% | 90% |
| b. 20% | 80% |
| c. 30% | 70% |

In a first test (Test 1) the tubes were shaken vigorously at room temperature and placed in a rack. The time required for the mixture to separate into two phases was recorded. The results were as follows:

| COMPOSITION % Lubricant | TIME 2 Phases | TIME TO CLEAR Top | Bottom |
|---|---|---|---|
| 10% | 10 Sec. | cloudy* | 45 min. |
| 20% | 10 Sec. | cloudy | 55 min. |
| 30% | 10 Sec. | cloudy | 63 min. |

*top phase remained milky white for duration of test

The above tests reveal that the mixed mineral oil/-PAG lubricant with R-134a on agitation forms a cloudy, emulsion like mixture which is stable for approximately an hour. This alteration of the fluid was unexpected and different from the behavior of mineral oil/R-134a mixtures, which separate rapidly into two clear phases, and PAG/R-134a mixtures, which form a single liquid phase at 25 Celsius. This "emulsification" may be responsible for the observed improvement in wear performance of mineral oil/PAG mixtures as lubricants for R-134a.

Additional miscibility data is found in Table 15. In addition, Table 15 includes the ISO viscosity data for the lubricants.

TABLE 15

| Lubricant/ Refrigerant | Lube Viscosity | Miscibility - 20% Lube/80% R-134a Neat 50/50 YN-9 | Ranking |
|---|---|---|---|
| Idemitsu YN-9/ R-12 | 96 | One Phase <−76 to >220 | 1 |
| Idemitsu FD46XG/ R-134a | 46 | One Phase <−76 to >140<br>Two Phase <−76 to >147 | 4.0 |
| Lubrizol 96290/ R-134a | | One Phase −11 to 201<br>Two Phase <−4 to 162 | 4.5 |
| Mitsui 2310/ R-134a | 136 | One Phase <−76 to 180<br>Two Phase <−75 to 167 | 3 |

TABLE 15-continued

| Lubricant/ Refrigerant | Miscibility - 20% Lube/80% R-134a Lube Viscosity | Neat 50/50 YN-9 | Ranking |
|---|---|---|---|
| Castrol 100/R-134a | 100 | One Phase −24 to >194<br>Two Phase −22 to >201 | 3 |
| DEA SE-80B/ R-134a | 80 | One Phase, <−76 to 167<br>Two Phase <−75 to 133 | 3.5 |
| Mobil 1681-2C/ R-134a | | One Phase −34 to >194<br>Two Phase −40 to >201 | 2.5 |
| Idemitsu SH-100/R-134a | 100 | One Phase <−76 to >200<br>Two Phase <−75 to 201 | 2 |
| Emery 3202-20/R-134a | | One Phase <−76 to 180<br>Two Phase, −75 to 136 | 3.5 |
| DEA SE-80B/ R-134a | 80 | Same as DEA SE-80B | 3.5 |

The above description of the invention has been described with respect to R-134a. However, it is believed that the invention is also applicable to other HFC refrigerants and HFC refrigerant blends which are known to have properties similar to R-134a.

While the invention has been described in connection with one of its preferred embodiments and exemplified with respect thereto, one skilled in the art will readily appreciate that various modifications, changes, omissions and substitutions may be made without departing from the spirit of the invention. It is intended, therefore, that the present invention be limited solely by the scope of the appended claims.

What is claimed is:

1. A refrigerant composition for use in a compression refrigeration apparatus; said composition comprising:

tetrafluoroethane refrigerant in combination with a lubricant composition;

said lubricant composition comprising a polyalkylene glycol lubricant and a mineral oil lubricant;

said polyalkylene glycol lubricant being present in an amount from about 90% to about 10% by weight of the lubricant composition; and said mineral oil lubricant being present in an amount from about 10% to about 90% by weight of the lubricant composition.

2. The composition of claim 1 wherein the refrigerant is 1,1,1,2-tetrafluoroethane.

3. The composition of claim 2 wherein the mineral oil is selected from the group consisting of paraffinic mineral oil and naphthenic mineral oil.

4. The composition of claim 1 wherein the polyalkylene glycol lubricant is present in an amount from about 80% to about 20% by weight of the lubricant composition and the mineral oil lubricant is present in an amount from about 20% to about 80% by weight of the lubricant composition.

5. The composition of claim 1 wherein the polyalkylene glycol lubricant is present in an amount from about 70% to about 30% by weight of the lubricant composition and the mineral oil lubricant is present in an amount from about 30% to about 70% by weight of the lubricant composition.

6. The composition of claim 5 wherein the synthetic lubricant and mineral lubricant are present in about equal amounts.

7. An improved compression refrigeration method which circulates a lubricant/refrigerant composition through a compression refrigeration apparatus wherein the improvement comprises using the composition of claim 1 as the lubricant/refrigerant composition.

8. The method of claim 7 wherein the refrigerant is 1,1,1,2-tetrafluoroethane.

9. The method of claim 8 wherein the mineral oil contained in the lubricant is selected from the group consisting of paraffinic mineral oil and naphthenic mineral oil.

10. The method of claim 8 wherein the synthetic lubricant and mineral oil are present in the lubricant composition in an amount from about 20% to about 80% by weight of the lubricant composition.

11. The method of claim 10 wherein the synthetic lubricant and mineral oil are present in the lubricant composition in an amount from about 30% to about 70% by weight of the lubricant composition.

12. The method of claim 11 wherein the synthetic lubricant and mineral oil are present in about equal amounts in the lubricant composition.

13. An improved method of lubricating a compression refrigeration apparatus which circulates a lubricant/refrigerant composition, said method comprising the steps of:

adding to the refrigeration apparatus a lubricant composition comprising a polyalkylene glycol lubricant and a mineral oil lubricant; the polyalkylene glycol lubricant being present in an amount from about 90% to about 10% by weight of the lubricant composition; the mineral oil lubricant being present in an amount from about 10% to about 90% by weight of the lubricant composition; and adding to the refrigeration apparatus a tetrafluoroethane refrigerant.

14. The method of claim 13 wherein the refrigerant is 1,1,1,2-tetrafluoroethane.

15. The method of claim 13 wherein the mineral oil is selected from the group consisting of paraffinic mineral oil and naphthenic mineral oil.

16. The method of claim 13 wherein the polyalkylene glycol lubricant is present in an amount from about 80% to about 20% by weight of the lubricant composition and the mineral oil lubricant is present in an amount from about 20% to about 80% by weight of the lubricant composition.

17. The method of claim 13 wherein the polyalkylene glycol lubricant is present in an amount from about 70% to about 30% by weight of the lubricant composition and the mineral oil lubricant is present in an amount from about 30% to about 70% by weight of the lubricant composition.

18. The method of claim 13 wherein the polyalkylene glycol lubricant and the mineral oil lubricant are present in the lubricant composition in about equal amounts by weight.

19. An improved method of lubricating a compression refrigeration apparatus which circulates a lubricant/refrigerant composition, said method comprising the step of:

adding to said refrigeration apparatus a refrigerant/lubricant composition comprising tetrafluoroethane refrigerant in combination with a lubricant composition;

said lubricant composition comprising a polyalkylene glycol lubricant and a mineral oil lubricant; said polyalkylene glycol lubricant being present in an amount from about 90% to about 10% by weight of the lubricant composition and said mineral oil lubricant being present in an amount from about 10% to about 90% by weight of the lubricant composition.

20. The method of claim 19 wherein the refrigerant is 1,1,1,2-tetrafluoroethane.

21. The method of claim 19 wherein the mineral oil is selected from the group consisting of paraffinic mineral oil and naphthenic mineral oil.

22. The method of claim 19 wherein the polyalkylene glycol lubricant is present in an amount from about 80% to about 20% by weight of the lubricant composition and the mineral oil lubricant is present in an amount from about 20% to about 80% by weight of the lubricant composition.

23. The method of claim 19 wherein the polyalkylene glycol lubricant is present in an amount from about 70% to about 30% by weight of the lubricant composition and the mineral oil lubricant is present in an amount from about 30% to about 70% by weight of the lubricant composition.

24. The method of claim 19 wherein the polyalkylene glycol lubricant and the mineral oil lubricant are present in the lubricant composition in about equal amounts by weight.

25. An improved method of retrofilling a compression refrigeration apparatus which circulates a lubricant/refrigerant composition which includes a mineral oil lubricant, said method comprising the step of:

removing from the refrigeration apparatus the old refrigerant;

leaving at least a portion of the mineral oil lubricant in the refrigeration apparatus;

adding to the refrigeration apparatus a polyalkylene glycol lubricant so as to form a lubricant composition in the compressor comprising a mixture of the polyalkylene glycol lubricant and the mineral oil lubricant; the polyalkylene glycol lubricant being present in an amount from about 90% to about 10% by weight of the lubricant composition and the mineral oil lubricant being present in an amount from about 10% to about 90% by weight of the lubricant composition; and adding to the refrigeration apparatus tetrafluoroethane refrigerant.

26. An improved compression refrigeration apparatus comprising:

a compressor containing a refrigerant/lubricant composition comprising tetrafluoroethane refrigerant in combination with a lubricant composition; and the lubricant composition comprising a polyalkylene glycol lubricant and a mineral oil lubricant; the polyalkylene glycol lubricant being present in an amount from about 90% to about 10% by weight of the lubricant composition and the mineral oil lubricant being present in an amount from about 10% to about 90% by weight of the lubricant composition.

* * * * *